US011802409B2

(12) United States Patent
Price

(10) Patent No.: US 11,802,409 B2
(45) Date of Patent: Oct. 31, 2023

(54) SYSTEMS AND METHODS FOR DECK RAILINGS AND DECK RAILING SHEER STRUT HARDWARE

(71) Applicant: Christopher Lange Price, Lynnwood, WA (US)

(72) Inventor: Christopher Lange Price, Lynnwood, WA (US)

( * ) Notice: Subject to any disclaimer, the term of this patent is extended or adjusted under 35 U.S.C. 154(b) by 921 days.

(21) Appl. No.: 16/696,995

(22) Filed: Nov. 26, 2019

(65) Prior Publication Data

US 2020/0165825 A1 May 28, 2020

Related U.S. Application Data

(60) Provisional application No. 62/772,580, filed on Nov. 28, 2018.

(51) Int. Cl.
*E04F 11/18* (2006.01)

(52) U.S. Cl.
CPC ..... *E04F 11/1817* (2013.01); *E04F 11/1842* (2013.01); *E04F 2011/1827* (2013.01)

(58) Field of Classification Search
CPC . E04B 1/003; E04H 17/1413; E04H 17/1417; E04H 17/1426; E04F 11/18; E04F 11/181; E04F 11/1812; E04F 11/1817; E04F 11/1842; E04F 2011/1819; E04F 2011/1823; E04F 2011/1825; E04F 2011/1827; E04F 2011/1829; E04F 2011/1831
See application file for complete search history.

(56) References Cited

U.S. PATENT DOCUMENTS

| | | | | |
|---|---|---|---|---|
| 4,809,955 | A * | 3/1989 | Veilleux | E04H 17/1417 256/65.02 |
| 5,613,664 | A | 3/1997 | Svalbe | |
| 5,649,688 | A | 7/1997 | Baker | |
| 6,494,438 | B1 | 12/2002 | Noirot et al. | |
| 6,874,766 | B2 * | 4/2005 | Curatolo | E04F 11/1817 256/64 |
| 6,889,960 | B1 | 5/2005 | Jones | |
| 6,932,329 | B1 | 8/2005 | Harder | |
| 7,441,750 | B1 | 10/2008 | Harder | |
| 7,478,799 | B2 | 1/2009 | Viviano | |
| 7,543,802 | B2 * | 6/2009 | Petta | E04F 11/1814 256/65.03 |
| 7,762,533 | B2 | 7/2010 | Derogatis et al. | |

(Continued)

*Primary Examiner* — Jonathan P Masinick
(74) *Attorney, Agent, or Firm* — LOZA & LOZA LLP; Richard H. Krukar

(57) ABSTRACT

A hardware system for use on a deck railing includes two pair of flat shear struts, one pair on each the lower and upper main rail each extending up to the length of each main rail between the deck posts. Both the upper and lower main rail shear strut pairs are identical and a mirror image of one another. The hardware system further includes an infill embodiment that includes a sub-rail that houses one of the shear struts in each pair, is attached to the sub-rail which is further attached to the balusters between the upper sub-rail and the lower sub-rail. The second shear strut in each pair is attached to the underside of the main upper rail and on top of the main lower rail. When the infill embodiment is placed into the deck railing frame opening, screws hold the railing infill in place creating a removable deck railing.

20 Claims, 12 Drawing Sheets

(56) References Cited

U.S. PATENT DOCUMENTS

| | | | | |
|---|---|---|---|---|
| 7,913,983 | B1 | 3/2011 | Sandor, Sr. | |
| 7,971,412 | B1 | 7/2011 | Lim | |
| 8,056,885 | B2 | 11/2011 | Sandor, Sr. | |
| 8,245,481 | B1 * | 8/2012 | Flynn | E04B 1/003 52/741.11 |
| 8,356,803 | B2 | 1/2013 | Truckner | |
| 9,126,289 | B2 | 9/2015 | Herman | |
| 9,145,705 | B2 | 9/2015 | Herman | |
| 9,410,351 | B2 * | 8/2016 | Ebeling | E04F 11/1842 |
| 9,410,568 | B2 | 8/2016 | O'Brien | |
| 9,611,650 | B1 | 4/2017 | Bizzarri et al. | |
| 9,689,410 | B2 | 6/2017 | Ostervig | |
| D797,307 | S | 9/2017 | Bizzarri et al. | |
| D797,953 | S | 9/2017 | Bizzarri et al. | |
| 9,790,689 | B2 | 10/2017 | Milanowski | |
| 9,822,547 | B2 | 11/2017 | Bizzarri et al. | |
| 10,550,917 | B2 * | 2/2020 | Ebeling | E05F 17/00 |
| 2006/0076545 | A1 | 4/2006 | Reynders et al. | |
| 2007/0138457 | A1 * | 6/2007 | Johnstonbaugh | E04F 11/1817 256/67 |
| 2007/0200105 | A1 | 8/2007 | Williams | |
| 2007/0246698 | A1 | 10/2007 | Truckner et al. | |
| 2009/0224222 | A1 * | 9/2009 | Dezen | E04F 11/1817 256/59 |
| 2009/0321704 | A1 | 12/2009 | Chung | |
| 2022/0356714 | A1 * | 11/2022 | Taylor | E04F 11/1817 |

* cited by examiner

SYSTEMS AND METHODS FOR DECK RAILINGS AND DECK RAILING SHEER STRUT HARDWARE

CROSS REFERENCE TO RELATED APPLICATIONS

This patent application claims the priority and benefit of U.S. provisional patent application No. 62/772,580, titled "DECK RAILING SHEAR STRUT HARDWARE," filed on Nov. 28, 2018, which is herein incorporated by reference in its entirety.

FIELD OF THE EMBODIMENTS

Embodiments are generally related to deck railing hardware and, more particularly, to hardware that allows a deck railing insert or infill to be removed while providing shear strength while installed.

BACKGROUND

Prior art deck railings consist of a three-point system, posts, rails and infill. Each of these attachment points are critical for the safety of a deck railing system and each rely on the quality of the attachments whereas the posts are attached mechanically to the deck, the rails both upper and lower are mechanically attached to the posts and the infill is mechanically attached to the upper and lower rails.

The traditional method of building a deck railing is on-site at the home of which the deck is being built, one piece at a time. First the posts are installed, then the main upper and lower rails that extend from post to post, and finally the balusters are attached directly to the main upper and lower rails to thereby form the infill. The infill is the structure between the posts and between the top rail and bottom rail. There are two general classifications, wood and non-wood products. Today the majority of deck railings are built on-site and out of wood which makes up the majority of the deck railing market. Non-wood products are creative alternatives to wood and are generally newer uses of materials such as aluminum, cables, other metals, composites and glass. These non-wood products are generally classified as deck railing systems, or come complete with the upper and lower rails, the infill that attaches to the rails and in many cases include the matching style of posts. What is common in all these products is the deck railing infill is permanently attached to the rails and posts.

It is a fact that all materials and products used to build a deck railing will need maintenance, whether it is simply cleaning or refinishing. Because railings systems are all permanently affixed to the deck, to reach the outside of the railing system to clean, refinish or even repair can be challenging, especially when you must use a ladder to reach the outside of the railing system. If you are dealing with a wood deck railing, the balusters are usually attached with a simple nail or screw, and removing them when the lumber rots or needs some other form of maintenance can consume a lot of time. Maintenance costs are typically higher when ease of access is diminished because of the railing system is permanently attached to the deck.

A variety of decks and deck railings are disclosed in the prior art. Following is a list of relevant prior art patents and patent applications, all of which are herein incorporated by reference in their entirety. The listed patents and patent applications are incorporated by reference for their teachings of deck railings and deck railing systems wherein the embodiments disclosed herein are advancements over those teachings. The list is:

- U.S. Pat. No. 9,689,410, issued Jun. 27, 2017, for RAILING SYSTEM, by Ostervig, which is herein incorporated by reference in its entirety;
- U.S. Pat. No. 7,478,799, issued Jan. 20, 2009, for RAILING SYSTEM, by Viviano, which is herein incorporated by reference in its entirety;
- United States patent publication 2006/0076545, published Apr. 13, 2006, for RAILING ASSEMBLIES AND RELATED METHODS AND APPARATUS, by Reynders et al., which is herein incorporated by reference in its entirety;
- United States patent publication 2007/0200105, published Aug. 30, 2007, for RAILING SYSTEM, by Williams, which is herein incorporated by reference in its entirety;
- U.S. Pat. No. 6,889,960, issued May 10, 2005, for CONNECTORS AND RAILING SYSTEM HAVING METAL BALUSTERS ISOLATED FROM CORROSION, by Jones, which is herein incorporated by reference in its entirety;
- U.S. Pat. No. 6,494,438, issued Dec. 17, 2002, for PLASTIC PORCH OR DECK RAILING SYSTEM AND COMPONANT PARTS THEREOF, by Noirot et al., which is herein incorporated by reference in its entirety;
- U.S. Pat. No. 5,649,688, issued Jul. 22, 1997, for RAILINGS WITH CONTINUOUS SPACERS, by Baker, which is herein incorporated by reference in its entirety;
- U.S. Pat. No. 5,613,664, issued Mar. 25, 1997, for PLASTIC FENCES AND METHOD FOR PREFABRICATING SUCH FENCES, by Svalbe, which is herein incorporated by reference in its entirety;
- U.S. Pat. No. 9,822,547, issued Nov. 21, 2017, for RAIL SYSTEM AND METHOD FOR ASSEMBLY, by Bizzarri et al., which is herein incorporated by reference in its entirety;
- U.S. Pat. No. 9,410,568, issued Aug. 9, 2016, for RAIL ATTACHMENT DEVICE, by O'Brien, which is herein incorporated by reference in its entirety;
- U.S. Pat. No. 9,611,650, issued Apr. 4, 2017, for RAIL SYSTEM AND METHOD FOR ASSEMBLY, by Bizzarri et al., which is herein incorporated by reference in its entirety;
- U.S. Pat. No. 9,126,289, issued Sep. 8, 2015, for RAILING SUPPORT POST WITH THREADED RECEIVERS, by Herman, which is herein incorporated by reference in its entirety;
- U.S. Pat. No. D797,307, issued Sep. 12, 2017, for RAIL ASSEMBLY, by Bizzarri et al., which is herein incorporated by reference in its entirety;
- U.S. Pat. No. D797,953, issued Sep. 19, 2017, for RAIL ASSEMBLY, by Bizzarri et al., which is herein incorporated by reference in its entirety;
- U.S. Pat. No. 7,762,533, issued Jul. 27, 2010, for FASTENERS, RAILING SYSTEM AND METHOD OF ASSEMBLY, by DeRogatis et al., which is herein incorporated by reference in its entirety;
- U.S. Pat. No. 9,145,705, issued Sep. 29, 2015, for RAILING SYSTEM AND TENSIONED POSTS USED THEREIN, by Herman, which is herein incorporated by reference in its entirety;

U.S. Pat. No. 7,913,983, issued Mar. 29, 2011, for STAIR, RAMP, OR BALCONY RAILING SYSTEM, by Sandor, Sr., which is herein incorporated by reference in its entirety;

U.S. Pat. No. 8,056,885, issued Nov. 15, 2011, for STAIR, RAMP, OR BALCONY RAILING SYSTEM, by Sandor, Sr., which is herein incorporated by reference in its entirety;

U.S. Pat. No. 9,790,689, issued Oct. 17, 2017, for BALUSTER CONNECTOR, by Milanowski, which is herein incorporated by reference in its entirety;

United States patent publication 2007/0246698, published Oct. 25, 2007, for BALUSTER BALL JOINT ADAPTER ATTACHMENT FOR A BALUSTER TO STAIR RAIL(S) AND BASE, by Truckner et al., which is herein incorporated by reference in its entirety;

United States patent publication 2009/0321704 A1, published Dec. 31, 2009, for BALUSTER ASSEMBLY, by Chung, which is herein incorporated by reference in its entirety;

U.S. Pat. No. 7,441,750, issued Oct. 28, 2008, for RAILING, by Harder, which is herein incorporated by reference in its entirety;

U.S. Pat. No. 6,932,329, issued Aug. 23, 2005, for RAILING, by Harder, which is herein incorporated by reference in its entirety;

U.S. Pat. No. 7,971,412, issued Jul. 5, 2011, for BALUSTER SYSTEM AND METHOD, by Lim, which is herein incorporated by reference in its entirety; and U.S. Pat. No. 8,356,803, issued Jan. 22, 2013, for ATTACHMENT FOR BALUSTER FOR STAIR, BALCONY OR LANDING RAILS FOR BOTH ADJUSTABLE AND FIXED RAILINGS, by Truckner, which is herein incorporated by reference in its entirety.

Systems and methods for improved deck rails are needed to speed installation and maintenance while improving quality.

SUMMARY

The following summary is provided to facilitate an understanding of some of the innovative features unique to the disclosed embodiments and is not intended to be a full description. A full appreciation of the various aspects of the embodiments disclosed herein can be gained by taking the entire specification, claims, drawings, and abstract as a whole.

When wood, metal, glass, cables, composites, or other materials are used to build a deck railing, there are several factors that will affect the result of the deck railing system.

A. Speed. Speed is important to contractors; hence shortcuts are often found in deck railings which include fewer nails or screws than there should be to attach a balustrade to the rails.

B. Quality control. Quality control is rarely considered during installation.

C. No third-party testing. A wood railing that is made in a factory and sold to the public as code compliant is required to pass testing by a third party. This testing consists essentially of applying a load, which can be up to 150 pounds per square foot, to test against the balusters or infill overall strength. The load value to test varies throughout the United States. In contrast, there is no third-party testing that occurs when constructing a railing from scratch in the field at the job site.

D. Material degradation. Poorly assembled railings will tend to rot faster than if quality assurance practices are followed, as can occur with factory assembly. It would be advantageous to provide a thin yet durable shear strut that is attached to the infill rails with many screws. When the opposite thin yet durable shear strut is attached to an infill rail with many screws, one has created a structural lateral hardware that due to the many screws will be mechanically fastened to the infill rail that will be of high resistance to shear off from the infill rail. This is in contrast to screwing the infill rail into the main rail with standard exterior screws where the materials could snap due to not dispersing any force placed against the screw.

It is an aspect of the embodiments that a removable deck railing system can include a removable infill assembly, a top shear strut, and a bottom shear strut. The embodiments are designed and configured to fit within and be attached to a deck railing frame. A deck railing frame generally has two posts, a top rail, and a bottom rail. The top rail and the bottom rail are between the posts and connect the posts to one another to thereby form a rectangular deck railing frame.

The removable infill assembly can include an upper infill rail, a lower infill rail, and one or more filling elements. The filling elements can be or include balusters, a panel, or slats. The upper infill rail, a lower infill rail, and one or more filling elements can be wood elements because many homeowner's desire wood railings or railing that appear to be completely made of wood. Similarly, the deck railing frame can be entirely wood in order to meet homeowner's aesthetic preferences.

The upper infill rail, filling elements, and lower infill rail can be attached to one another to form the removable infill assembly with the upper infill rail above the filling elements and the lower infill rail below the filling elements. An upper infill shear strut can be attached to the upper infill rail's top surface, which is the side opposite the filling elements. A lower infill shear strut can be attached to the lower infill rail's bottom surface, which is the side opposite the filling elements. In such an embodiment, the upper infill shear strut is above the upper infill rail and is attached to the upper infill rail, the lower infill shear strut is below the lower infill rail and is attached to the lower infill rail, the filling elements are below the upper infill rail, above the lower infill rail, and are connected to the upper infill rail and to the lower infill rail.

A top shear strut can be configured for attachment to a deck railing frame's top rail. The top shear strut can be attached to the bottom of the top rail such that it can interface with the removable infill assembly. A bottom shear strut can be configured for attachment to a deck railing frame's bottom rail. The bottom shear strut can be attached to the top of the bottom rail such that it can interface with the removable infill assembly. As such, the removable infill assembly is configured for being positioned within and removably attached to the deck railing frame. When used, the upper infill shear struts can be removably attached to the top shear strut, and the lower infill shear strut can be removably attached to the bottom shear strut.

It is a further aspect of the embodiments that the upper infill shear strut, the lower infill shear strut, the top shear strut, and the bottom shear strut can be carbon fiber. The use of carbon fiber is not merely a selection of an available material but is the result of prototyping, testing, and evaluation. A deck railing system must be tested to prove that it meets certain structural and mechanical requirements before it can be sold through many commercial outlets or used by most reputable builders. An embodiment has recently undergone third party testing and exceeded the required mechanical and structural requirements for such railing systems. The tested embodiment had posts, top rail, bottom rail, upper infill rail, lower infill rail, and fill elements that were made of wood. The shear struts (upper infill shear strut, lower infill shear strut, top shear strut, and bottom shear strut) were made of carbon fiber. This particular mix of materials not only passed the tests, but the embodiment appears to be entirely wood because the shear struts are hidden. Furthermore, the removable infill assembly is light and rigid which means it can be uninstalled and reinstalled numerous times with a low risk of deformation or damage. Alternative embodiments may have shear struts that are fiberglass, steel, aluminum, or some other material.

It is an aspect of the embodiments that threaded inserts and lock-down screws can be used to removably attach the upper infill shear strut to the top shear strut and to removably attach the lower infill shear strut to the bottom shear strut. Those practiced in the repair or production of furniture or mechanical devices are familiar with threaded inserts. A threaded insert is a fastening element that can be pressed into or screwed into a hole in a first element, such as a shear strut. A threaded hole in the threaded insert provides for a screw to be threaded into the threaded insert to thereby fasten a second element, such as an upper infill shear strut, to the first element. For example, some threaded inserts have external threads such that they can be screwed into a properly sized hole. Such threaded inserts can be screwed into holes in the top shear strut. In some embodiments the threaded insert can be threaded into a hole in the top shear strut and into a hole the top rail, the holes being aligned, such that the threaded insert helps fasten the top shear strut to the top rail. In other embodiments, the shear strut does not enter the main rail. The removable infill assembly can then be held in the deck railing frame by lock-down screws that extend through holes in the upper infill rail and the upper infill shear strut. The lock-down screws are threaded into the threaded insert. Lock-down screws and threaded inserts can hold the bottom of the removable infill assembly in the deck railing frame. An addition threaded insert can be installed in the bottom shear strut by being screwed into or pressed into a hole. The lower infill shear strut can be attached to the bottom shear strut by an additional lock-down screw that extends through the lower infill rail and the lower infill shear strut and is threaded into the additional threaded insert.

The removable infill assembly can be held in the deck railing frame by spring-loaded binding elements. A bottom spring-loaded binding element can be attached to the bottom shear strut or bottom rail. The lower infill rail can have a lower cavity that interacts with the spring-loaded binding element to releasably hold the lower infill rail within the deck railing frame. A top spring-loaded binding element can be attached to the top shear strut or top rail. The upper infill rail can have a top cavity that interacts with the spring-loaded binding element to releasably hold the lower infill rail within the deck railing frame.

It is yet a further aspect of the embodiments to install a removeable infill assembly in a deck railing frame with a method comprising removably attaching a removable infill assembly in a deck railing frame comprising a top rail, a bottom rail, and two posts wherein the two posts are connected by the top rail and the bottom rail to thereby form the deck railing frame. The removable infill assembly comprises an upper infill rail, a lower infill rail, and one or more filling elements. The one or more filling elements are below the upper infill rail and are connected to the upper infill rail. The one or more filling elements are above the lower infill rail and are connected to the lower infill rail. A top shear strut can be attached to the top rail on its bottom side. A bottom shear strut can be attached to the bottom rail on its top side. The removable infill assembly engages the top shear strut and the bottom shear strut when the removable infill assembly is positioned within and removably attached to the deck railing frame.

A through screw can be provided for attaching the infill in place after it is inserted inside the opening of the deck railing frame. The deck railing frame is formed by the upper and lower main rails and the two posts. The screws can mechanically attach the shear struts together. Since there are two shear struts on top and two shear struts on the bottom, through screws that penetrate through both sets of shear struts will create a stronger shear value than if one were to just screw the in-field insert through for example, a wood sub-rail into the wood main rail. This mechanical integrity can be applied to various materials such as steels, aluminum, titanium, composites and other industry used materials like fiberglass and carbon fiber.

The embodiments provide for easy removal on the infill insert from the main rails and posts for maintenance. The embodiments also provide for easy removal on the infill insert from the main sub rails and posts for painting and sanding when not in place and prior to placing in position. A further advantage of the embodiments is that they allow for exacting hole allocation or hardware location for future replacement infill railings. For example, original and replacement removable infill assemblies using finish lock-down screws passing though finish lock-down screw holes that travel through both the lower infill rail and the upper infill rail and through the top shear strut and bottom shear strut into threaded inserts. The finish lock-down screws can remain in place until removed to allow the removable infill assembly to be pulled out of the deck railing frame. A permanent installation of the bottom shear strut and the top shear strut will always be there during the infill replacement. Removable infill assemblies infill can change but the finish lock-down screw holes will always align with the top and bottom shear struts.

The upper and lower infill rails can have a lip, called a raised edge, such that when the replaceable infill assembly is placed into the railing frame the raised edge that aligns the replaceable infill assembly in deck railing frame and creates a stop preventing the replaceable infill assembly from going further than the hardware allows after attachment to the main rails.

BRIEF DESCRIPTION OF THE FIGURES

The accompanying figures, in which like reference numerals refer to identical or functionally-similar elements throughout the separate views and which are incorporated in and form a part of the specification, further illustrate the present embodiments and, together with the detailed description of the embodiments, serve to explain the principles of the present embodiments. The figures are not necessarily to scale or full scale.

DETAILED DESCRIPTION

The particular values and configurations discussed in these non-limiting examples can be varied and are cited merely to illustrate at least one embodiment and are not intended to limit the scope thereof.

The embodiments will now be described more fully hereinafter with reference to the accompanying drawings, in which illustrative embodiments of the embodiments are shown. The embodiments disclosed herein can be embodied in many different forms and should not be construed as limited to the embodiments set forth herein; rather, these embodiments are provided so that this disclosure will be thorough and complete, and will fully convey the scope of the embodiments to those skilled in the art. Like numbers refer to like elements throughout. As used herein, the term "and/or" includes any and all combinations of one or more of the associated listed items.

Figure 1:
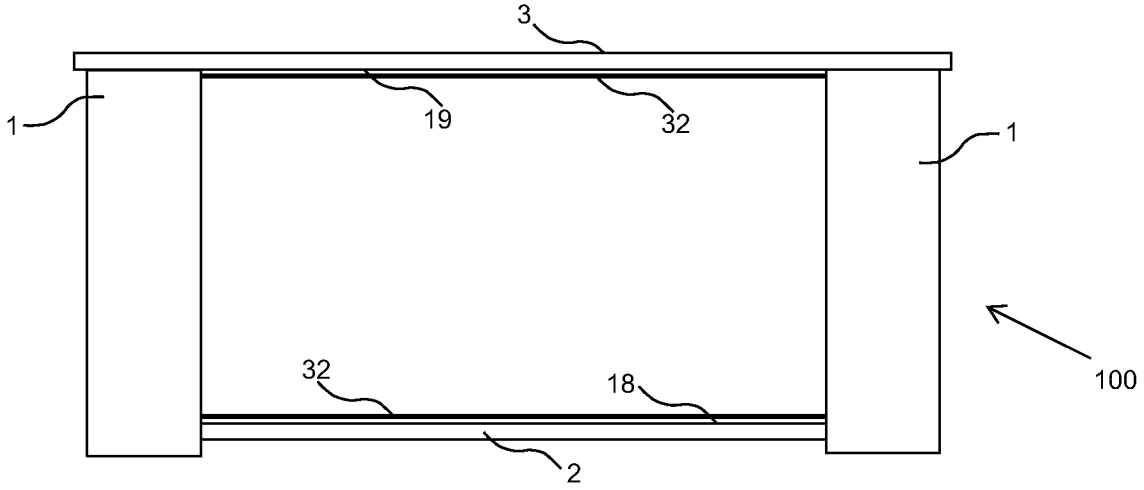
FIG. 1 illustrates a deck railing frame in accordance with aspects of the embodiments.

FIG. 1 illustrates a deck railing frame 100 in accordance with aspects of the embodiments. Two posts 1 are connected by a top rail 3 and a bottom rail 2. A top shear strut 19 is attached to the top rail 3. A bottom shear strut 18 is attached to the bottom rail 2. Sub-rails 32 are attached to the top shear strut 3 and the bottom shear strut 2.

Figure 2A:
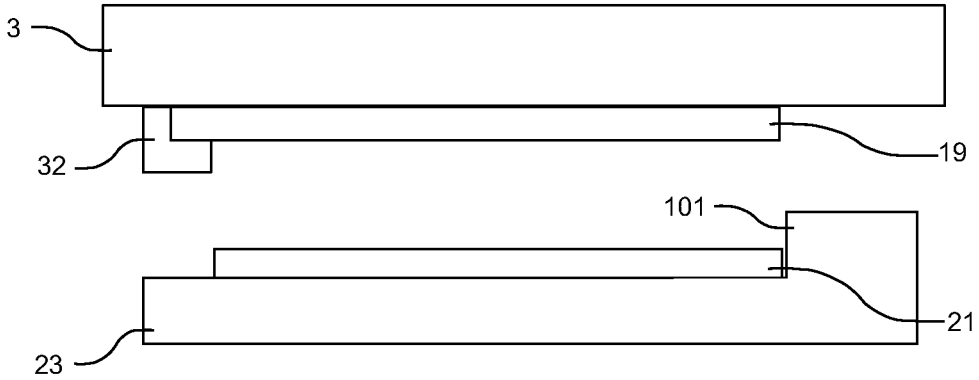
FIGS. 2*a* and 2*b* illustrate a top rail and top shear strut interfacing with an upper infill rail and upper infill shear strut in accordance with aspects of the embodiments.
Figure 2B:
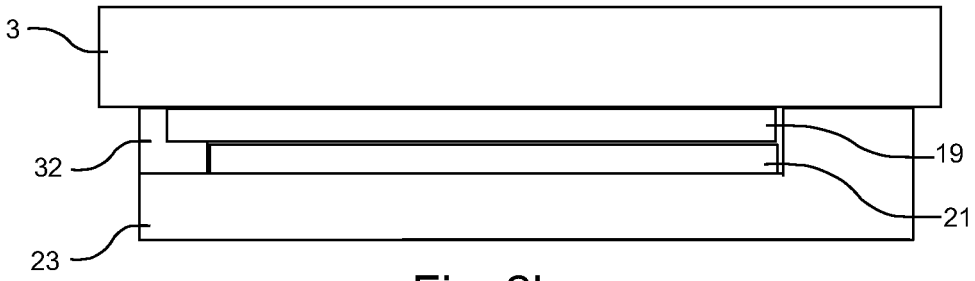

FIGS. 2*a* and 2*b* illustrate a top rail 3 and top shear strut 19 interfacing with an upper infill rail 23 and upper infill shear strut 21 in accordance with aspects of the embodiments. A sub-rail 32 is attached to top shear strut 19 and can hide the gap between the top rail 3 and the upper infill rail 23. When interfacing as shown in FIG. 2*b*, the sub-rail 32 can act as a stop and help align the upper infill shear strut 21 and the top shear strut 19. The upper infill rail 23 has a step 101 that can also act as a stop and help align the upper infill shear strut and the top shear strut. In addition, the step 101 can help align the upper infill shear strut 21 and the upper infill rail 23 when the upper infill shear strut 21 is attached to the upper infill rail 23. The sub-rail 32, top rail 3 and upper infill rail 23 can all be made of the same wood such that, when assembled as shown in FIG. 2*b*, the assembly appears to be entirely wood. Alternatively, the sub-rail 32 can be plastic, such as acrylonitrile butadiene styrene (ABS), aluminum, carbon fiber, fiberglass, or another material.

Figure 3:
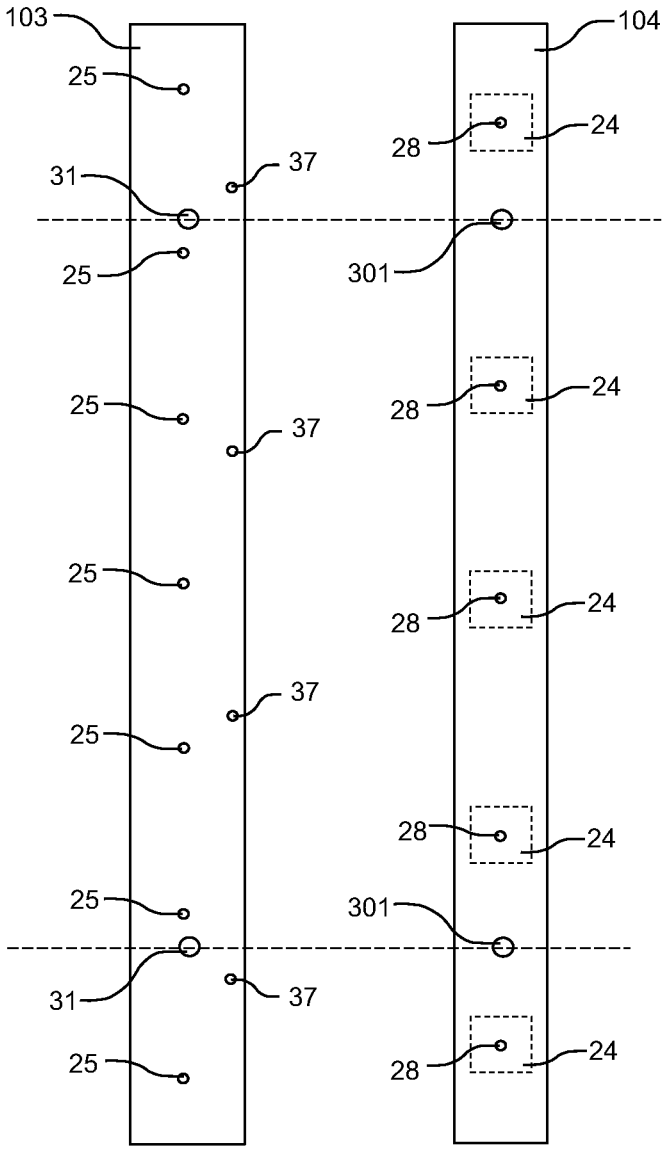
FIG. 3 illustrates illustrate a shear strut and an infill shear strut in accordance with aspects of the embodiments.

FIG. 3 illustrates a shear strut 103 and an infill shear strut 104 in accordance with aspects of the embodiments. The top shear strut 19 and the bottom shear strut 18 can be identical to shear strut 103. The upper infill shear strut 21 and the lower infill shear strut 20 can be identical to infill shear strut 104. Shear struts 103 can be attached to the main rails 2, 3 of the deck railing frame 100 by main rail screws inserted into main rail screw holes 25. The main rail screw holes 25 can be countersunk such that the main rail screws do no extend past the surface of the shear strut 103. Sub-rail 32 can be attached to the shear strut by sub-rail screws passing through sub-rail screw holes 37. The sub-rail screw holes 37 can be countersunk such that the sub-rail screws do no extend past the surface of the shear strut 103. Alternatively, the sub-rail can be attached using an adhesive or double-sided tape. The sub-rail can be attached to the shear strut 103, the main rail, or both.

Infill shear struts 104 can be attached to the infill rails 22, 23 of the removeable infill assembly 105 by infill rail screws inserted into infill rail screw holes 28. The infill rail screw holes 28 can be countersunk. Balusters 24 can be attached by infill rail screws that pass though the infill rail screw holes 28, through an infill rail 22, 23 and into the baluster 24.

Threaded inserts 29 can be installed in threaded insert hole 31. Infill shear struts 104 can be attached to shear struts 103 by lock-down screws 26 extending through lock-down screw holes 301 and threaded into the threaded inserts 29 installed in threaded insert holes 31.

The embodiments have been described as using various screws to fixedly attach structural elements together. The disclosure of screws is non-limiting because those practiced in the building trades are well aware of other ways to fasten elements, those ways including adhesives, bolts, nuts, dowels, and biscuits.

Figure 4:
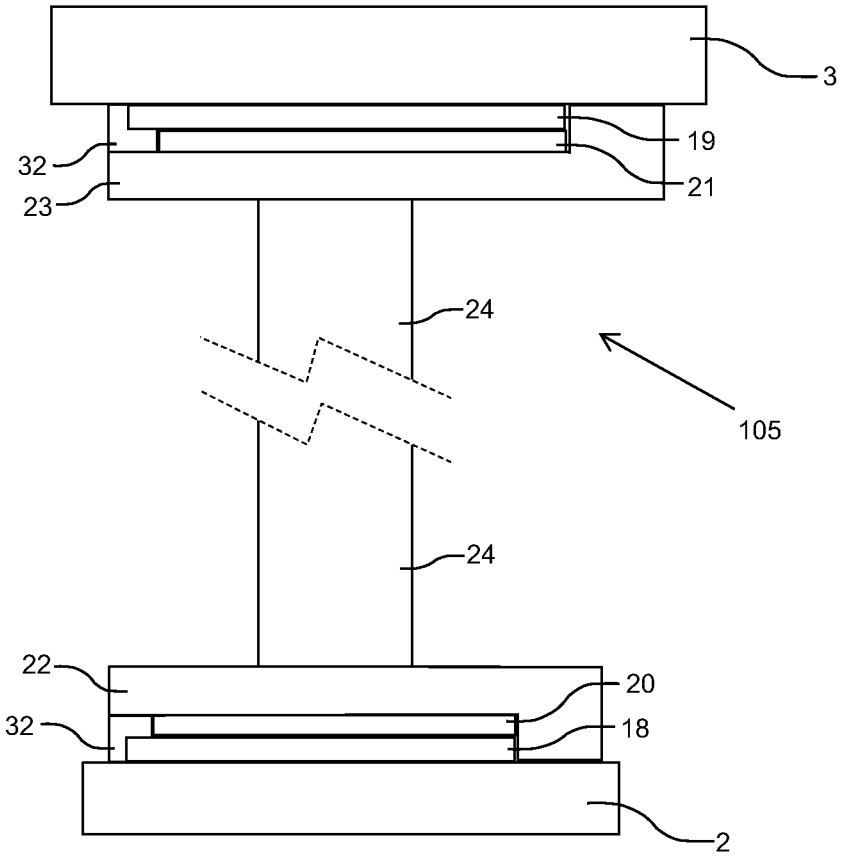
FIG. 4 illustrates a cut view from the side of a removable infill assembly installed in a deck railing frame in accordance with aspects of the embodiments.

FIG. 4 illustrates a cut view from the side of a removable infill assembly 105 installed in a deck railing frame 100 in accordance with aspects of the embodiments. The filling elements of the removeable infill assembly 105 is balusters 24 connecting the upper infill rail 23 to the lower infill rail 22. The bottom shear strut 18 is attached to the bottom rail 2 while the top shear strut 19 is attached to the top rail 3. The upper infill shear strut 21 is attached to the upper infill rail 23 while the lower infill shear strut 20 is attached to the lower infill rail 22. Sub-rails 32 are attached to the shear struts 18, 19.

Figure 5:
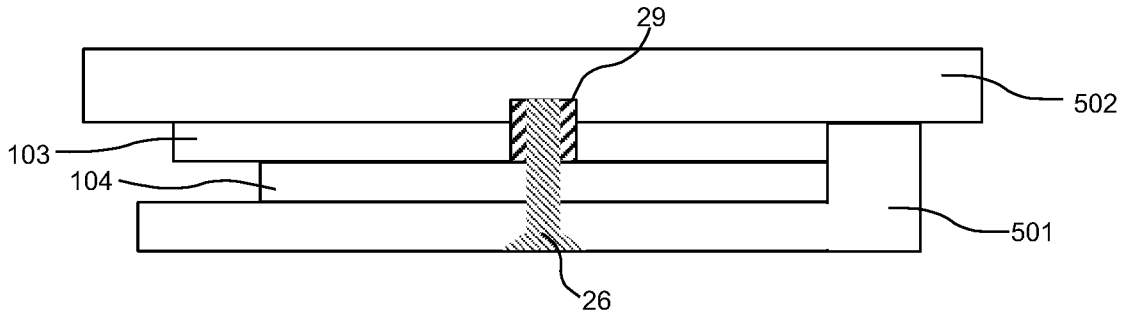
FIG. 5 illustrates a threaded insert and lock-down screw attaching a shear strut and an infill shear strut in accordance with aspects of the embodiments.

FIG. 5 illustrates a threaded insert 29 and lock-down screw 26 attaching a shear strut 103 an infill shear strut 104 in accordance with aspects of the embodiments. The threaded insert 29 is installed in the shear strut 103 by being screwed or pressed into a threaded insert hole 31. The lock-down screw 26 extends through infill rail 501, through a lock-down screw hole 301 in the infill shear strut 104, and is threaded into threaded insert 29. The hole in the infill rail 501 is shown to be countersunk. Infill rail 501 can be upper infill rail 23 and/or lower infill rail 22. In this non-limiting embodiment, the threaded insert is illustrated as extending through the shear strut and into the main rail 502. The main rail can be the top rail 3 or the bottom rail 2.

Figure 6:
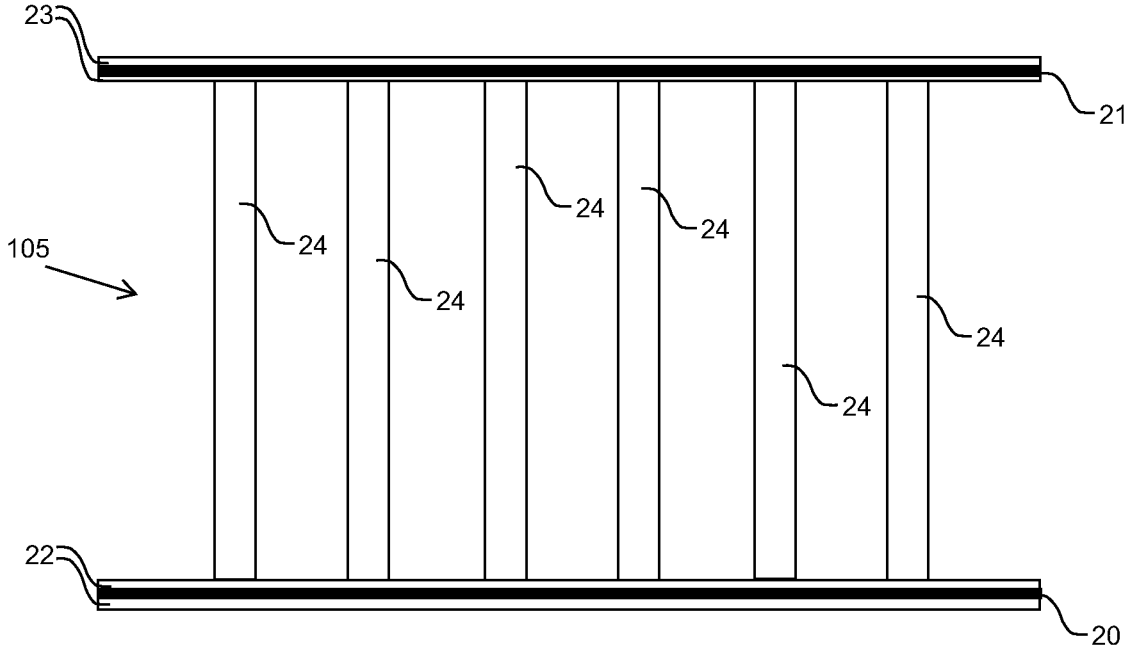
FIG. 6 illustrates a front view of a removable infill assembly in accordance with aspects of the embodiments.

FIG. 6 illustrates a front view of a removable infill assembly 105 in accordance with aspects of the embodiments. The filling elements of the removable infill assembly 105 are balusters 24 connecting the upper infill rail 23 to the lower infill rail 22. The upper infill shear strut 21 is attached to the upper infill rail 23 while the lower infill shear strut 20 is attached to the lower infill rail 22. The plurality of balusters are illustrated as being the same. In practice, the balusters can have different designs.

Figure 7:
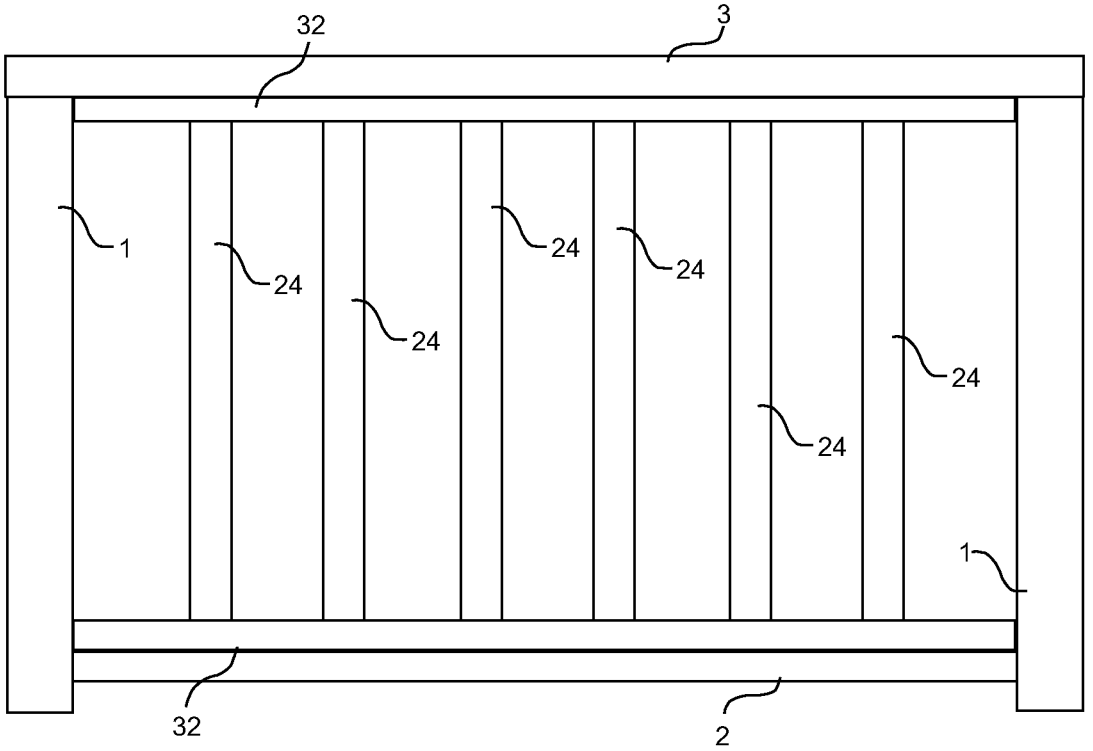
FIG. 7 illustrates a front view of a removable infill assembly installed in a deck railing frame in accordance with aspects of the embodiments.

FIG. 7 illustrates a front view of a removable infill assembly 105 installed in a deck railing frame 100 in accordance with aspects of the embodiments. Here, the deck railing frame is viewed from the side opposite that of FIG. 1.

Figure 8:
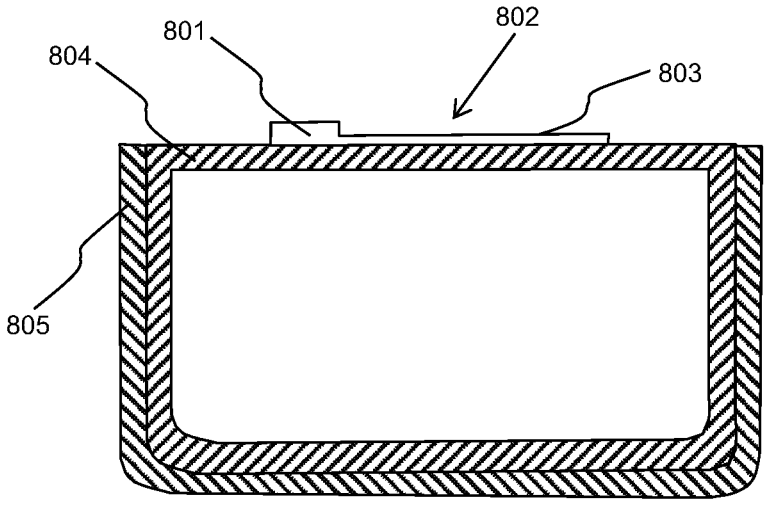
FIG. 8 illustrates a shear strut rail attached to an adapter installed in a U channel rail in accordance with aspects of the embodiments.

FIG. 8 illustrates a rail shear strut 802 attached to an adapter 804 installed in a U channel rail 805 in accordance with aspects of the embodiments. Deck railing can use preformed U channels as top and bottom rails. An adapter 804 can be formed that fits into the U channel and a rail shear strut 802 can be attached to adapter 804. Note that in some applications that the adapter 804 does not need to be fastened or adhered to the U channel because the infill, once installed, keeps the adapter 804 in the U channel 805. The illustrated adapter 804 fits against the inside surface of the U-channel 805. Other possibilities include one or more legs extending from the top of the adapter down to the U-channel. In general, the adapter has a top surface to which the rail shear strut 802 is attached and has a lower structure that interfaces with the U channel and keeps the top surface in position. The top surface is positioned such that the U channel 805 does not prevent the removeable infill assembly from sliding into position relative to the top rail shear strut and bottom rail shear strut as discussed above. Rail shear strut 802 has a raised section 801 similar in function to sub-rail 32 and a main section 803 similar in function to shear strut 103.

Figure 9:
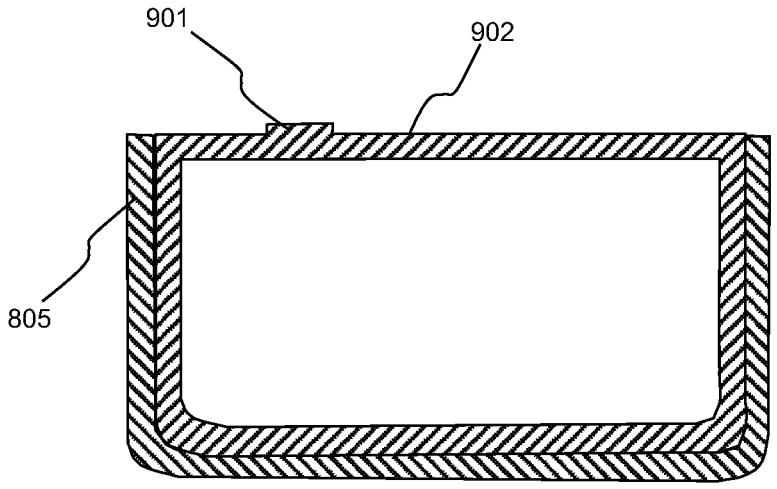
FIG. 9 illustrates an adapter with an integrated shear strut installed in a U channel rail in accordance with aspects of the embodiments.

FIG. 9 illustrates an adapter 902 with an integrated shear strut installed in a U channel rail 805 in accordance with aspects of the embodiments. The adapter of FIG. 9 is similar to that of FIG. 8 excepting that the rail shear strut is a raised section 901 on top of the adapter 902. FIG. 8 shows that the rail shear strut has a main section 803 and a raised section 801. Here, only the raised section 901 is formed as part of the adapter 902. Other embodiments can have the main section as well, as seen in FIG. 12. Note that the adapters illustrated in FIGS. 8-12 can all be extrusions.

Figure 10:
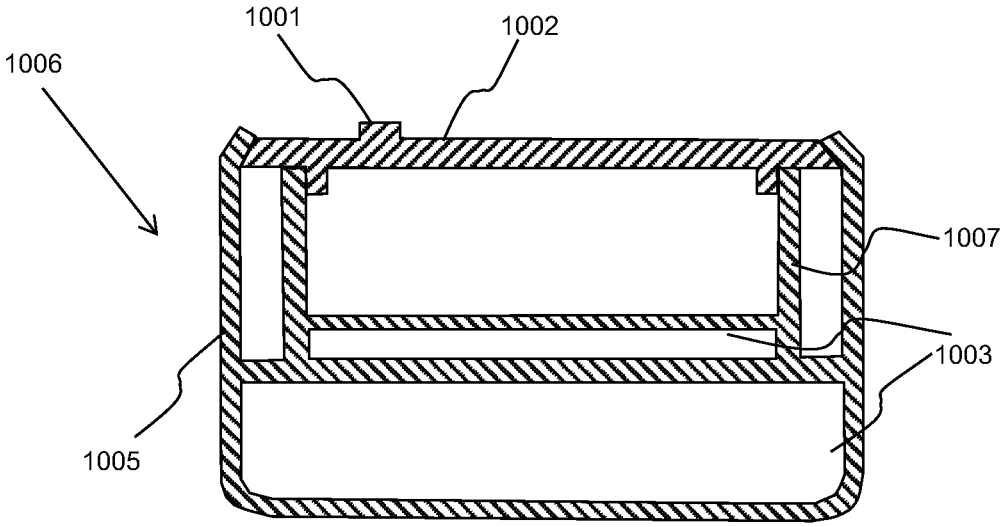
FIG. 10 illustrates an adapter with an integrated shear strut installed in a competitor's rail in accordance with aspects of the embodiments.

FIG. 10 illustrates an adapter 1002 with an integrated shear strut installed in a competitor's rail 1006 in accordance with aspects of the embodiments. Note that the competitor's rail 1006 is an extruded rail and is a fairly complex structure with an internal cavity 1003, exterior walls 1005, and interior walls 1007. The adapter 1002 is designed to interface with the competitor's rail 1006 such that removable infill assembly 105 can be installed as described above in relation to installing a removable infill assembly 105 in a deck railing frame 100. As in FIG. 9, the adapter 1002 is formed with a raised section that can act as sub-rail 32.

Figure 11:
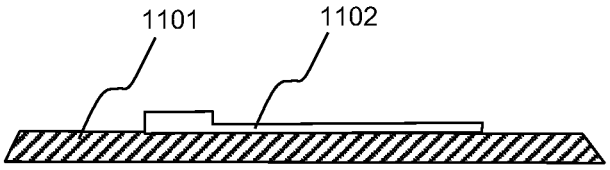
FIG. 11 illustrates a shear strut rail attached to an adapter in accordance with aspects of the embodiments.
Figure 12:
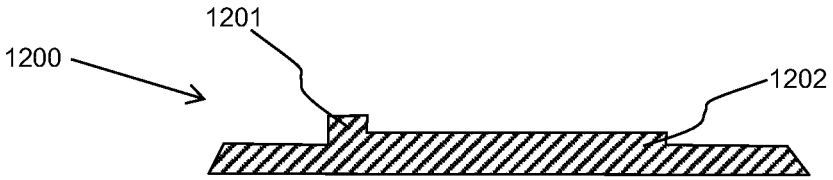
FIG. 12 illustrates an adapter with an integrated shear strut in accordance with aspects of the embodiments.

FIG. 11 illustrates a rail shear strut 802 attached to an adapter 1101 in accordance with aspects of the embodiments. Here, as in FIG. 8, a rail shear strut 802 is attached to the adapter 1101. The adapter is designed to fit into competitor's rail of FIG. 10.

FIG. 12 illustrates an adapter 1200 with an integrated shear strut in accordance with aspects of the embodiments. The adapter 1200 has an integrated rail strut in which both the raised section 1201 and the main section 1202 of a rail shear strut are formed as part of the adapter.

Figure 13:
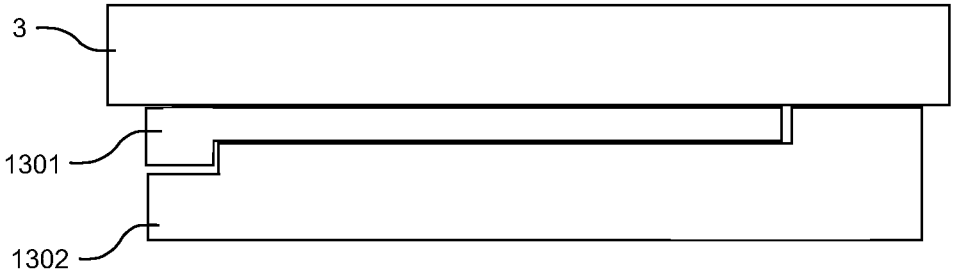
FIG. 13 illustrates a top rail 3 and unitary shear strut 1301 interfacing with a unitary infill rail 1302 in accordance with aspects of the embodiments.

FIG. 13 illustrates a top rail 3 and unitary shear strut 1301 interfacing with a unitary infill rail 1302 in accordance with aspects of the embodiments. The unitary shear strut 1301 combines sub-rail 32 and shear strut 103 into a single unit. The unitary infill rail 1302 combines infill rail 501 and infill shear strut 104 into a single unit.

Figure 14:
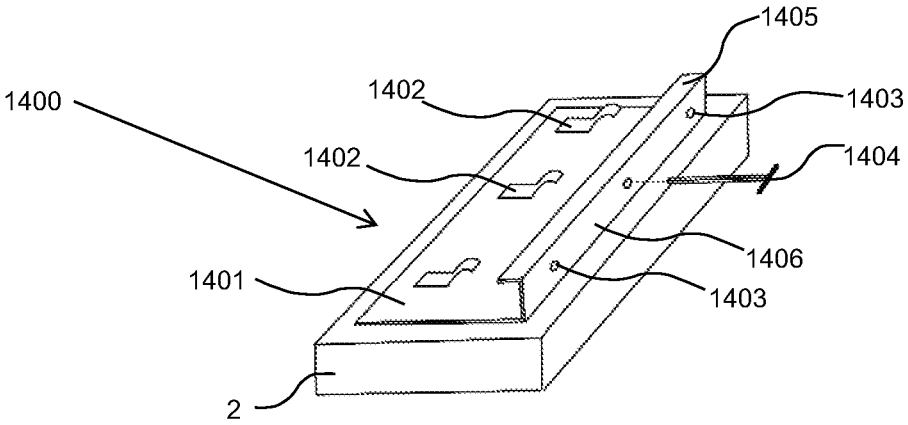
FIG. 14 illustrates a shear strut with spring-loaded binding elements in accordance with aspects of the embodiments.

FIG. 14 illustrates a shear strut 1400 with spring-loaded binding elements 1402 in accordance with aspects of the embodiments. The shear strut 1400 can have three flat surfaces such as the main section 1401, face 1406, and top flat 1405. The spring-loaded elements 1402 are attached to the main section 1401. A key 1404 can pass through key hole 1403 to flatten or depress a spring-loaded binding element 1402 toward the main section 1401.

Figure 15:
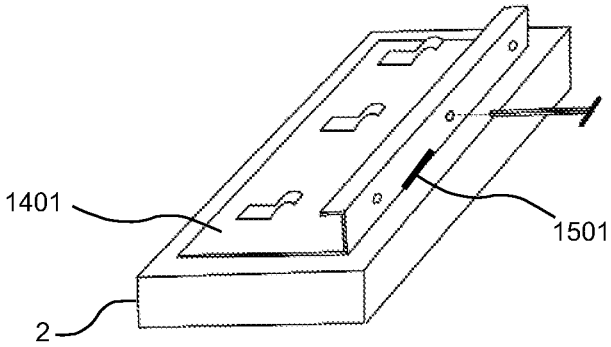
FIG. 15 illustrates a shear strut with spring-loaded binding elements and key stowage in accordance with aspects of the embodiments.

FIG. 15 illustrates a shear strut with spring-loaded binding elements 1402 and key stowage 1501 in accordance with aspects of the embodiments. The key 1404 is needed for removing and reinstalling removeable infill assemblies. As such, the shear strut and/or the infill rails 1601 can incorporate a key stowage 1501 to hold the key 1404 between uses.

Figure 16:
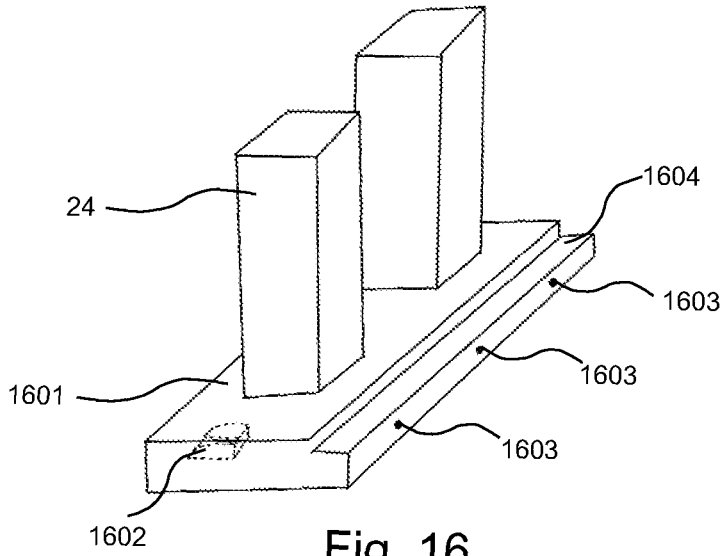
FIG. 16 illustrates a lower infill rail with a bottom cavity for interacting with a spring-loaded binding element to releasably hold the lower infill rail within the deck railing frame in accordance with aspects of the embodiments.

FIG. 16 illustrates a lower infill rail 1601 with a bottom cavity 1602 for interacting with a spring-loaded binding element 1402 to releasably hold the lower infill rail 1601 within the deck railing frame in accordance with aspects of the embodiments. The key 1404 can pass through holes 1603 and into cavity 1602 to flatten the spring-loaded binding element 1402 and thereby release the removeable infill assembly.

Figure 17:
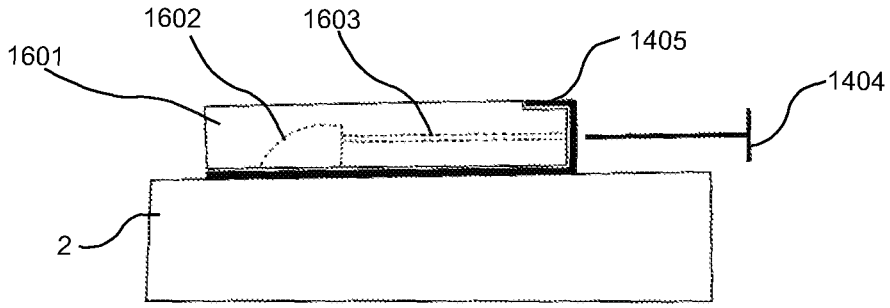
FIG. 17 illustrates a side view of an infill rail interfacing with a shear strut in accordance with aspects of the embodiments.

FIG. 17 illustrates a side view of an infill rail 1601 interfacing with a shear strut 1400 in accordance with aspects of the embodiments. A step 1604 can underlay the top flat 1405 to help hold the lower infill rail 1601 in position. For clarity, the spring-loaded binding element 1402 is not shown within cavity 1602. Element 1603 is a key way that provides access for the key to depress the spring-loaded binding element 1402. In an alternative embodiment, the keyway can enter the opposite side of the infill rail and intersect the curved edge of the cavity.

Figure 18:
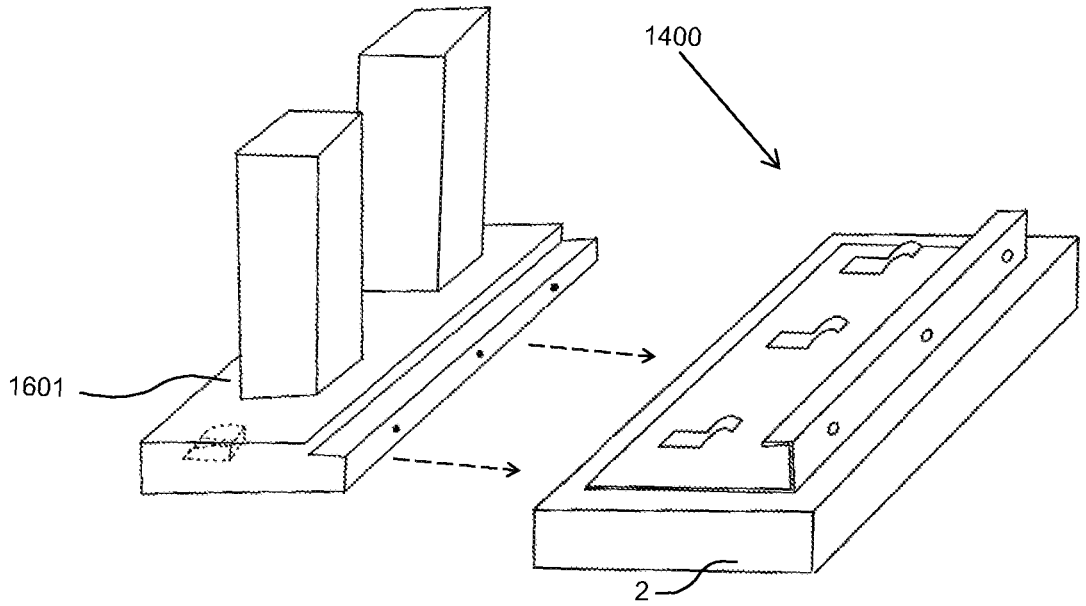
FIG. 18 illustrates assembling a lower infill rail to a bottom rail in accordance with aspects of the embodiments.

FIG. 18 illustrates assembling a lower infill rail 1601 to a bottom rail 2 in accordance with aspects of the embodiments. No key is 1404 is needed because the spring-loaded binding elements 1402 are exposed.

Figure 19:
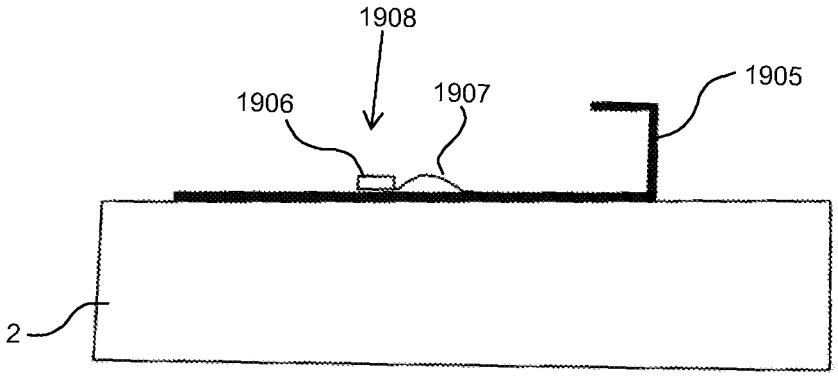
FIG. 19 illustrates another spring-loaded binding element attached to a shear strut in accordance with aspects of the embodiments.

FIG. 19 illustrates another spring-loaded binding element 1908 attached to a shear strut 1905 in accordance with aspects of the embodiments. Here, the shear strut 1905 is similar to that of FIGS. 14, 15, and 18 excepting for using a different spring-loaded binding element 1908. Here, the spring 1907 holds the binding element 1906 down such that it does not engage an infill rail. Inserting the key 1904 presses the binding element upwards. As such, the embodiment of FIGS. 19-21 is designed for keeping and retaining the key 1904 with the key 1904 being removed in order to release a removeable infill assembly.

Figure 20:
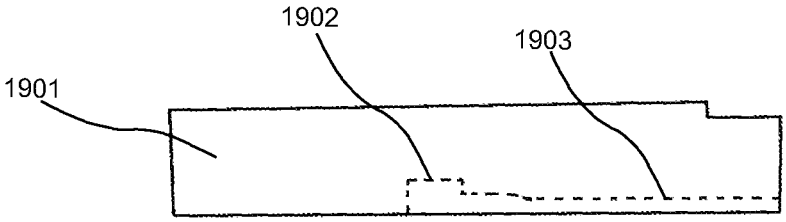
FIG. 20 illustrates an infill rail with a cavity configured for the spring-loaded binding element of FIG. 19 in accordance with aspects of the embodiments.

FIG. 20 illustrates an infill rail 1901 with a cavity 1902 configured for the spring-loaded binding element of FIG. 19 in accordance with aspects of the embodiments. During installation, the binding element 1906 passes through key way 1903.

Figure 21:
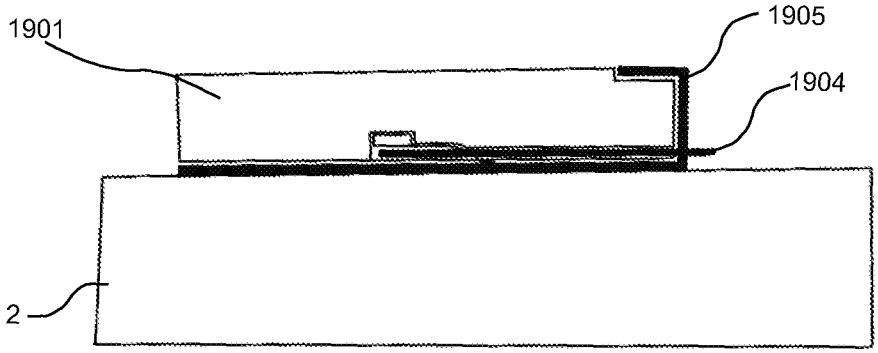
FIG. 21 illustrates the infill rail of FIG. 20 interfacing with the shear strut of FIG. 19 in accordance with aspects of the embodiments.

FIG. 21 illustrates the infill rail 1901 of FIG. 20 interfacing with the shear strut 1905 of FIG. 19 in accordance with aspects of the embodiments. Key 1904 is in position and has pressed binding element 1906 into cavity 1902 to thereby lock the infill rail 1901 in position.

Figure 22:
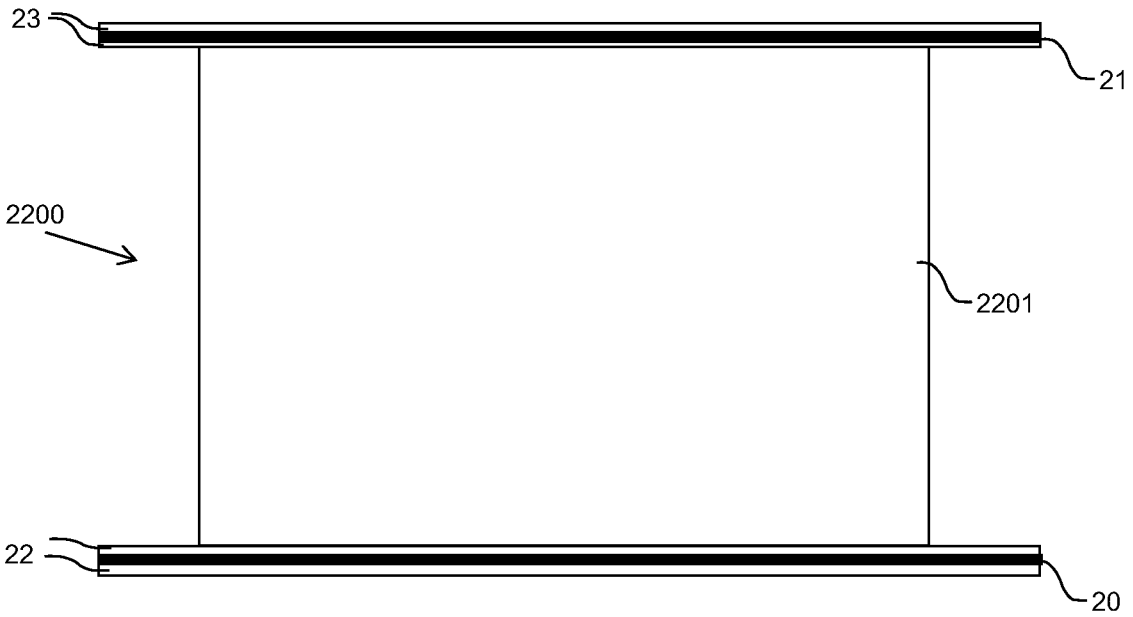
FIG. 22 illustrates a removeable infill assembly with a panel in accordance with aspects of the embodiments.

FIG. 22 illustrates a removeable infill assembly 2200 with a panel 2201 in accordance with aspects of the embodiments.

Figure 23:
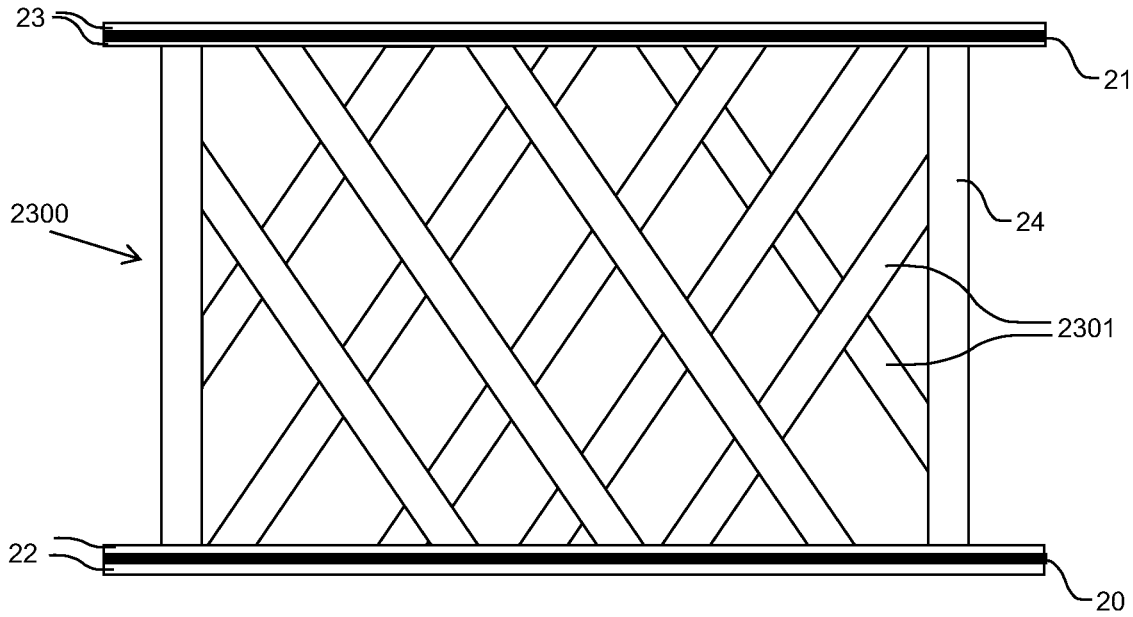
FIG. 23 illustrates a removeable infill assembly with slats in accordance with aspects of the embodiments.

FIG. 23 illustrates a removeable infill assembly 2300 with slats 2301 in accordance with aspects of the embodiments. The plurality of slats are shown in a cross pattern. The cross pattern is non-limiting because the slats can be arranged in different patterns which can include a plurality of balusters.

Figure 24:
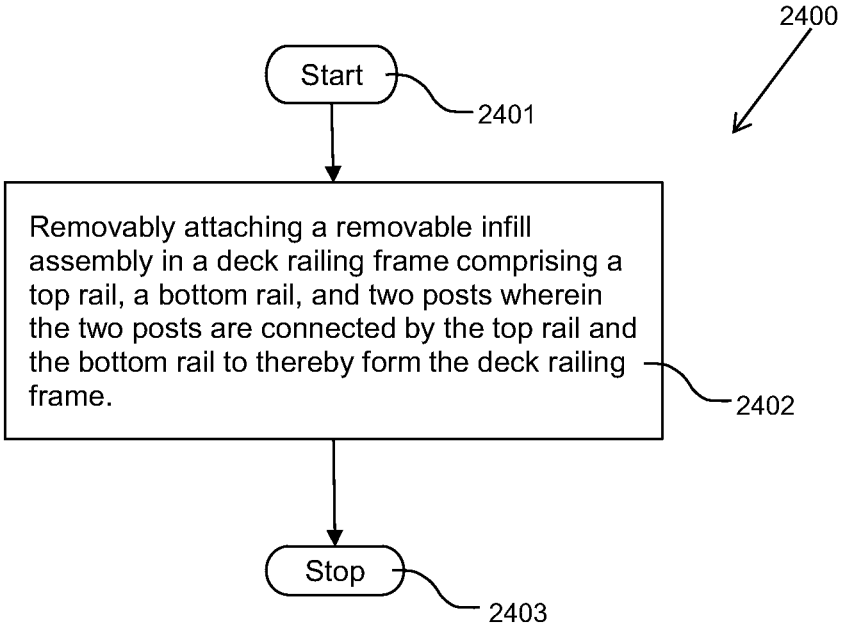
FIG. 24 illustrates a method, the method being a method for removably attaching a removable infill assembly in a deck railing frame in accordance with aspects of the embodiments.

FIG. 24 illustrates a method 2400, the method being a method for removably attaching a removable infill assembly in a deck railing frame in accordance with aspects of the embodiments. After the start 2401, removably attaching a removable infill assembly in a deck railing frame occurs 2402 with the deck railing frame comprising a top rail, a bottom rail, and two posts, and wherein the two posts are connected by the top rail and the bottom rail to thereby form the deck railing frame. The method 2400 may then stop 2403.

There are a multitude of materials available to manufacture the embodiments including composites, metals, fiberglass, and carbon fiber. Each has different characteristics. The deck railing frame and its material composition may directly affect what material or materials are best suited for a specific application or installation. As a general rule, the weaker the deck railing frame, the stronger the removable deck railing infill system needs to be because the removable deck railing infill system provides needed strength to the deck railing. If the infill attaches to the posts as well as the main rails then it can strengthen the entire deck railing frame, otherwise, it principally strengthens and joins the main rails. Below are some of the most popular materials on the markets today for deck railings. The general characteristics are presented and solutions to their mechanical deficiencies using the removable deck railing infill system are provided.

Regarding Composites:

Composites are often made from mainly recycled plastics. There are different grades, each having different strength values. For example, some lower main rails made from composite materials have "mid-supports" between rail and deck that prevent the lower main rail from sagging. Over time composites generally succumb to the ultra violet rays of the sun and end up discoloring to various degrees further damaging the integrity of the product.

Composite materials typically have a matrix material and a reinforcement material. Fiberglass typically has a matrix of polyester resin matrix and a glass fiber reinforcement. Fiberglass is sometimes called "fiberglass reinforced plastic" because the glass fibers itself is sometimes referred to as fiberglass. Carbon fiber reinforced polymer (CFRP) typically has a polymer resin matrix and carbon fibers as the reinforcement. A CFRP item is often referred to as a carbon fiber item. For example, a CFRP rod is often called a carbon fiber rod. Note, as used herein, "carbon fiber" refers to CFRP while "carbon fibers" refers to the CFRP reinforcement material.

Regarding Fiberglass:

Fiberglass tends to break down under ultraviolet sun rays promoting splintering and increased product weakness.

Regarding Aluminum:

Aluminum is another popular material used for decks and deck railings. Aluminum products for railings are usually extrusions. The thickness of extrusions can be easily controlled. Manufacturers often try to minimize the extrusion thickness while still providing strength such that their products pass building code testing. While each component of the deck railing in an aluminum structure may be weaker than the fully assembled structure, individual aluminum components can bend easily. For example, someone standing on the bottom rail of an aluminum railing can bend that rail even though the full structure can easily support the weight of that person without damage to the structure.

Regarding Plastic:

Some decks and deck railings are made completely or partially from thermoplastic. Filled thermoplastics have filler materials such as minerals, clays, fibers, etc. Those practiced in forming thermoplastics are familiar with filled thermoplastics. Thermoplastics can be extruded or molded.

Regarding Wood:

Depending on the wood species used, the moisture content and condition, the strength of a deck railing can change drastically. Wood railings are mostly built on-site and are not always built with strength in mind, nor are they tested on site. Contractors and inexperienced DIY installers do not always build the railings correctly as the tempting ability to get the job done quickly means more money in contractors' pockets and the inexperience of DIY builders will generally compromise the result. The correct choice of fasteners, how lumber is cut and treated, and the installation are all variables in the inevitable demise of a wood railing system.

FAIL NOT Hardware System:

The embodiments use Fail Not Hardware. Fail Not Hardware is designed to fit factory made wood railing inserts or infill panels that will go in-between the posts and upper & lower main rails of a deck frame. The Fail Not Hardware System can also be fit in the openings of competitor rail frame deck systems by using adapters or modified hardware. In other words, the Deck Railing Inserts made by Fence Quarter, LLC can be ordered to fit a wood, composite or metal deck railing frame system of the customer's choosing even if the posts and upper/lower rails are sourced from another manufacturer. This provides customers more choices. If the customer or end user does not use wood rails or posts but wants a particular wood infill, this FAIL NOT Hardware along with the proper modifications will allow the non-wood rails and posts to be used with wooden infill. The rails and posts are more maintenance free than wood while the wood infill panel may give the customer a particular and more popular look and feel. The Fail Not Hardware system also allows for the ease of removing the infill panels for maintenance.

The Fail Not Hardware for wood railing infill panels can be CFRP hardware formed from long thin sheets of carbon fiber. The CFRP FAIL Not hardware thereby has the light weight and high strength characteristics typical of CFRP items. This hardware is never directly exposed to the sun rays because it is hidden during installation. Carbon Fiber does not fall apart and with the correct resin can handle temperatures well above the most extreme temperatures decks will receive to prevent melting and failure.

Fail Not Hardware can be used for existing and for competitor railing frame structures. There are a multitude of competitor railing frame designs on the market. For instance if the main rails of a system are nothing more than a u-channel and a cap, such that exists with a Trex system, one would need to add to the Fail Not Carbon Fiber a filler to fit into the u-shaped channel of the main rails to make the main rails more substantial and increase their strength as part of the Fail Not Hardware System. These modifications can be of different shapes and sizes to match the specific needs of the manufacture of the railing frames product line. An interesting comparable example is Weather Tech, a company who retrofits car mats to the specific size of the car manufacture. In the example above, a filler made of a material similar to the manufacture's product provides similar physical properties and may act consistent with that product and better maintain integrity. The filler can be installed before the Fail Not hardware. After the filler is installed, the Fail Not top hardware piece is applied and increases the shear value or lateral strength to help prevent railing blow-out should a person fall against such railing. Due to the various materials used from different manufactures, the Fail Not Hardware System may incorporate like materials in conjunction with the CFRP. Carbon Fiber is superior in weight and strength amongst all materials mentioned.

Another option does not use CFRP for the Fail Not Hardware but instead uses all like materials for a given competitor railing frame product. For example, aluminum fail not hardware can be used with a competitor's aluminum railing frame product. A removable infill can be assembled just like the previously described removable infills but without the carbon fiber, and although not as strong may still pass testing for code compliance by inserting the Fail Not hardware or infill into and between the competitor railings after installing the "filler" and simply screwing the infill down to and into the filler. Hence part of the Fail Not Hardware is the "filler" of competitor like materials and a lateral stop (similar to sub-rail 32, stops of shear struts 1301, 1302) can be built into the filler to prevent the infill from being pushed outward.

Since other modifications and changes varied to fit particular operating requirements and environments will be apparent to those skilled in the art, the invention is not considered limited to the examples chosen for purposes of illustration and disclosure and covers all changes and modifications which do not constitute departures from the true spirit and scope of the specification, drawings, and illustrative claims.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A removable deck railing infill system comprising:

a removable infill assembly comprising an upper infill shear strut, a lower infill shear strut, an upper infill rail, a lower infill rail, and one or more filling elements, wherein the upper infill shear strut is above the upper infill rail and is attached to the upper infill rail, wherein the lower infill shear strut is below the lower infill rail and is attached to the lower infill rail, wherein the one or more filling elements are below the upper infill rail and are connected to the upper infill rail, and wherein the one or more filling elements are above the lower infill rail and are connected to the lower infill rail;

a top shear strut configured for attachment to a top rail wherein a deck railing frame comprises the top rail, a bottom rail, and two posts connected by the top rail and the bottom rail to thereby form the deck railing frame;

a bottom shear strut configured for attachment to the bottom rail; and wherein the removable infill assembly is configured for being positioned within and removably attached to the deck railing frame with the upper infill shear strut removably attached to the top shear strut, and the lower infill shear strut removably attached to the bottom shear strut.

2. The removable deck railing infill system of claim 1 wherein the one or more filling elements comprises a plurality of balusters.

3. The removable deck railing infill system of claim 1 wherein the one or more filling elements comprises a panel.

4. The removable deck railing infill system of claim 1 wherein the one or more filling elements comprises a plurality of slats.

5. The removable deck railing infill system of claim 1 wherein the upper infill shear strut, the lower infill shear strut, the top shear strut, and the bottom shear strut are carbon fiber.

6. The removable deck railing infill system of claim 1 further comprising a threaded insert installed in the top shear strut wherein the upper infill shear strut is attached to the top shear strut by a lock-down screw that extends through the upper infill rail and the upper infill shear strut and is threaded into the threaded insert.

7. The removable deck railing infill system of claim 6 further comprising an additional threaded insert installed in the bottom shear strut wherein the lower infill shear strut is attached to the bottom shear strut by an additional lock-down screw that extends through the lower infill rail and the lower infill shear strut and is threaded into the additional threaded insert.

8. A removable deck railing infill system comprising:

a removable infill assembly comprising an upper infill rail, a lower infill rail, and one or more filling elements, wherein the one or more filling elements are below the upper infill rail and are connected to the upper infill rail, and wherein the one or more filling elements are above the lower infill rail and are connected to the lower infill rail;

a top shear strut configured for attachment to a top rail wherein a deck railing frame comprises the top rail, a bottom rail, and two posts connected by the top rail and the bottom rail to thereby form the deck railing frame; and a bottom shear strut configured for attachment to the bottom rail, wherein the removable infill assembly is configured for being positioned within and removably attached to the deck railing frame, wherein the removable infill assembly further comprises an infill shear strut that is an upper infill shear strut or a lower infill shear strut, wherein the infill shear strut is attached to the upper infill rail or to the lower infill rail, and wherein the infill shear strut is configured to be removably attached to the top shear strut or to the bottom shear strut.

9. The removable deck railing infill system of claim 8 further comprising a bottom spring-loaded binding element attached to the bottom shear strut wherein the lower infill rail comprises a lower cavity that interacts with the bottom spring-loaded binding element to releasably hold the lower infill rail within the deck railing frame.

10. The removable deck railing infill system of claim 9 further comprising a top spring-loaded binding element attached to the top shear strut wherein the upper infill rail comprises a top cavity that interacts with the top spring-loaded binding element to releasably hold the upper infill rail within the deck railing frame.

11. The removable deck railing infill system of claim 8 further comprising a top spring-loaded binding element attached to the top shear strut wherein the upper infill rail comprises a top cavity that interacts with the top spring-loaded binding element to releasably hold the upper infill rail within the deck railing frame.

12. The removable deck railing infill system of claim 8 wherein the infill shear strut is the upper infill shear strut that is attached to the upper infill rail.

13. The removable deck railing infill system of claim 8 wherein the infill shear strut is the lower infill shear strut that is attached to the lower infill rail.

14. The removable deck railing infill system of claim 8 wherein a threaded insert is installed in the top shear strut or in the bottom shear strut, wherein the infill shear strut is attached to the top shear strut or to the bottom shear strut by a lock-down screw that is threaded into the threaded insert, and wherein the lock-down screw that extends through the lower infill shear strut or the upper infill shear strut.

15. The removable deck railing infill system of claim 14 further comprising:

a bottom spring-loaded binding element attached to the bottom shear strut wherein the lower infill rail comprises a bottom cavity that interacts with the bottom spring-loaded binding element to releasably hold the lower infill rail within the deck railing frame; and a top spring-loaded binding element attached to the top shear strut wherein the upper infill rail comprises a top cavity that interacts with the top spring-loaded binding element to releasably hold the lower infill rail within the deck railing frame;

wherein the one or more filling elements comprises a plurality of balusters;

wherein the one or more filling elements comprises a panel;

wherein the one or more filling elements comprises a plurality of slats; and wherein the upper infill shear strut, the lower infill shear strut, the top shear strut and the bottom shear strut are carbon fiber.

16. A method comprising:

removably attaching a removable infill assembly in a deck railing frame comprising a top rail, a bottom rail, and two posts wherein the two posts are connected by the top rail and the bottom rail to thereby form the deck railing frame;

wherein the removable infill assembly comprises an upper infill rail, a lower infill rail, and one or more filling elements, wherein the one or more filling elements are below the upper infill rail and are connected to the upper infill rail, and wherein the one or more filling elements are above the lower infill rail and are connected to the lower infill rail;

wherein a top shear strut is attached to the top rail;

wherein a bottom shear strut is attached to the bottom rail; and wherein the removable infill assembly engages the top shear strut and the bottom shear strut when the removable infill assembly is positioned within and removably attached to the deck railing frame, wherein the removable infill assembly further comprises an infill shear strut that is an upper infill shear strut or a lower infill shear strut, wherein the infill shear strut is attached to the upper infill rail or to the lower infill rail, and wherein the infill shear strut is configured to be removably attached to the top shear strut or to the bottom shear strut.

17. The method of claim 16 wherein the infill shear strut is the upper infill shear strut that is attached to the upper infill rail, and wherein the upper infill shear strut is removably attached to the top shear strut when the removable infill assembly is removably attached to the deck railing frame.

18. The method of claim 16 wherein the infill shear strut is the lower infill shear strut that is attached to the lower infill rail, and wherein the lower infill shear strut is removably attached to the bottom shear strut when the removable infill assembly is removably attached to the deck railing frame.

19. The method of claim 16 wherein the infill shear strut is carbon fiber.

20. The method of claim 16 wherein a threaded insert is installed in the top shear strut or in the bottom shear strut, wherein the infill shear strut is attached to the top shear strut or to the bottom shear strut by a lock-down screw that is threaded into the threaded insert, and wherein the lock-down screw that extends through the lower infill shear strut or the upper infill shear strut.

* * * * *